US005903100A

United States Patent [19]

Peng et al.

[11] Patent Number: 5,903,100

[45] Date of Patent: May 11, 1999

[54] REDUCTION OF SMEARING IN COLD CATHODE DISPLAYS

[75] Inventors: Chao-Chi Peng, Chinchu; Chi-Hua Wang, Hsinchu, both of Taiwan

[73] Assignee: Industrial Technology Research Institute, Hsin-Chu, Taiwan

[21] Appl. No.: 08/813,720

[22] Filed: Mar. 7, 1997

[51] Int. Cl.[6] ..... H01J 19/38

[52] U.S. Cl. ..... 313/497; 445/24; 445/58

[58] Field of Search ..... 445/24, 50, 58; 313/495, 309, 497

[56] References Cited

U.S. PATENT DOCUMENTS

| | | | |
|---|---|---|---|
| 5,338,240 | 8/1994 | Kim | 445/24 |
| 5,478,611 | 12/1995 | Hashimoto | 428/1 |
| 5,517,031 | 5/1996 | Wei et al. | 250/370.08 |

FOREIGN PATENT DOCUMENTS

| | | | |
|---|---|---|---|
| 1311406 | 3/1973 | United Kingdom | 445/58 |

*Primary Examiner*—Kenneth J. Ramsey
*Attorney, Agent, or Firm*—George O. Saile; Stephen B. Ackerman

[57] ABSTRACT

A problem associated with field emission displays is that of 'smearing' where an otherwise sharp image appears to be surrounded by a diffuse halo of light. Our investigations have suggested that this is due to spurious reflections from the surface of the gate electrode layer. To eliminate these we have deposited an anti-reflection coating on the top surface of the gate electrode layer. This prevents the reflection of light rays travelling away from the phosphor layer towards the cathode. Such rays, if their reflection were allowed, would emerge at a different spot in the display from what was intended, resulting in a false image. A method for manufacturing a field emission display based on this approach is also described.

20 Claims, 2 Drawing Sheets

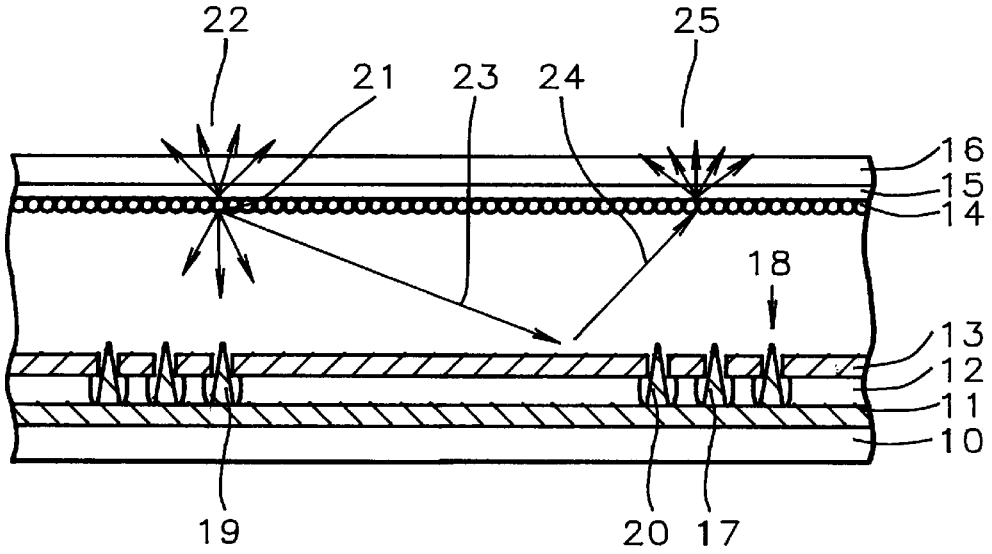
FIG. 1 – Prior Art
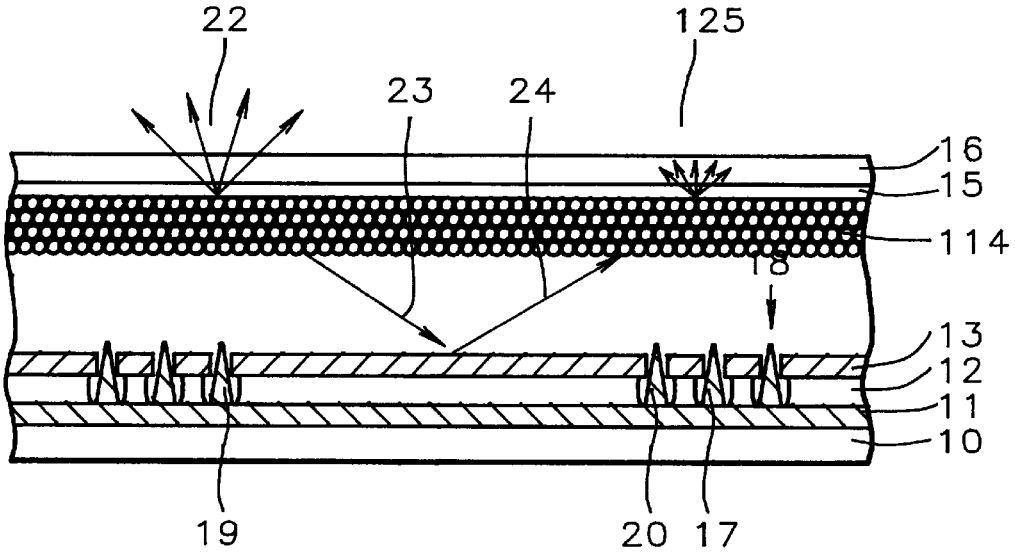
FIG. 2 – Prior Art

REDUCTION OF SMEARING IN COLD CATHODE DISPLAYS

BACKGROUND OF THE INVENTION (1). Field of the Invention

The invention relates to the general field of field emission displays with particular reference to problems of image smearing.

(2). Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines at an angle (usually 90°) to them, intersecting with them at the locations of the conical emitters or microtips, and connected to a source of relatively positive voltage.

The electrons that are emitted by the cold cathodes accelerate past openings in the gate lines and strike a layer of phosphor that is located some distance above the gate lines. Thus, one or more microtips serves as a sub-pixel for the total display. The number of sub-pixels that will be combined to constitute a single pixel depends on the resolution of the display and on the operating current that is to be used. In general, even though the local electric field in the immediate vicinity of a microtip is in excess of 1 million volts/cm., the externally applied voltage is under a 100 volts.

A number of factors affect the sharpness of the images that are formed in displays of this type, for example the degree to which the electron beam diverges after it has passed through the gate electrode. A problem, known to be associated with this type of display, is that of 'smearing' where an otherwise sharp image appears to be surrounded by a diffuse halo of light. The origins of this defect are not entirely clear but our own investigations suggest that it is due to spurious reflections from the surface of the gate electrode layer.

We will amplify this by reference to FIG. 1. Seen there is a schematic cross-section of a cold cathode display of the type that we have been discussing above. Cathode electrode 11 (normally in the form of extended columns) lies on lower dielectric substrate 10. Immediately above cathode 11 is dielectric layer 12 which serves to support gate electrode 13 (normally in the form of rows running at right angles to the cathode columns) as well as to electrically insulate it relative to 11. Holes, such as 18, have been formed in the gate electrode and these holes extend down to the surface of cathode layer 11. In each such hole a conical microtip, made of material such as molybdenum or silicon, is seated. Positioned some distance above the microtips by means of insulating spacers (not shown) is upper dielectric substrate 16 on whose downward facing surface layer 15 of transparent conducting material, indium tin oxide (ITO), has been deposited. The ITO in turn is covered with layer 14 of a suitable phosphor which will emit light in some desired wavelength range when it is struck by electrons coming from the microtips.

Continuing our reference to FIG. 1, we show there a phosphor particle 21 that, having been subjected to bombardment by electrons coming from microtip 19, emits phosphorescent light rays 22 in all directions, both outwardly (and hence seen as part of the display) and inwardly where the majority of them are lost and not seen by an external viewer. However, a small fraction of rays 22, represented in the figure as ray 23, arrive at the surface of gate electrode layer 13. The latter is typically made of niobium or molybdenum and provides a good reflecting surface. The resulting reflected ray (shown as 24 in the figure) is then returned to the upper substrate, passing through phosphor layer 14 on its way. As it passes through the phosphor layer, ray 24 may get diverted by refraction. The net result is the emergence of rays 25 which give an outside viewer the impression that they originated from microtip 20 instead of from microtip 19. This we believe to be the origin of the smearing phenomenon discussed above.

In the prior art, as far as we are aware, the only way in which the smearing problem has been dealt with has been to increase the thickness of the phosphor layer. This is illustrated in FIG. 2 which can be seen to be the same as FIG. 1 except that phosphor layer 114 is substantially thicker than corresponding phosphor layer 14 in FIG. 1. The result of this change is that reflected ray 24 is now subject to significant attenuation on its way to the surface so that the cone of emitted light 125 which is visible to an external viewer is significantly fainter than corresponding cone 25 in FIG. 1. While this approach does reduce the amount of smearing, it does so at the cost of a fainter image since the light associated with a given electron has more material to penetrate on its way to the surface.

Wei et al. (U.S. Pat. No. 5,517,031 May 1996) shows a photosensor array where the photosensors are backed up by an opaque layer to eliminate false imaging effects. Hashimoto (U.S. Pat. No. 5,478,611 December 1995) describes a type of black matrix for an LCD display while Kim (U.S. Pat. No. 5,338,240 August 1994) also describes a black matrix for an LCD display based on using two substrates.

SUMMARY OF THE INVENTION

It has been an object of the present invention to provide a field emission display that produces a sharp image free of the defect known as 'smearing'.

Another object of the present invention has been to provide a field emission display that produces a sharp image free of the defect known as 'smearing' without any dimunition in the brightness of said image.

Yet another object of the present invention has been to provide a field emission display that produces a sharp image free of the defect known as 'smearing' without the need to increase the thickness of the display's phosphor layer.

These objects have been achieved by placing an anti-reflection coating on the top surface of the gate electrode layer. This prevents the reflection of light rays travelling away from the phosphor layer towards the cathode. Such rays, if their reflection were allowed, would emerge at a different spot in the display from what was intended, resulting in a false image. A method for manufacturing a field emission display based on these improvements is described.

BRIEF DESCRIPTION OF THE DRAWINGS

FIG. 1 is a cross-section of a field emission device showing how some of the light associated with one pixel may end up appearing to come from a different pixel.

FIG. 2 shows how the problem highlighted in FIG. 1 has been solved in the prior art.

DESCRIPTION OF THE PREFERRED EMBODIMENTS

Figure 3:
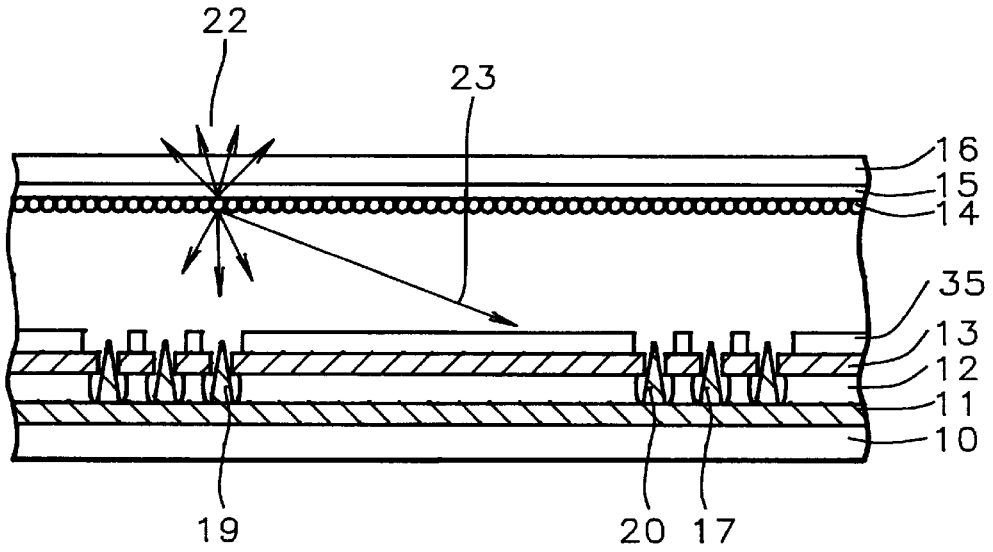
FIG. 3 shows how the problem highlighted in FIG. 1 has been solved according to the teachings of the present invention.

Referring now to FIG. 3, we illustrate how the present invention solves the smearing problem without the need to increase the thickness of the phosphor layer. As in FIG. 1, a phosphor particle, when struck by an electron emitted from a microtip such as 19, may emit light in almost any direction including ray 23 which is directed downwards towards the interior of the display. In an important departure from the prior art, anti-reflection coating 35 has been deposited over gate layer 35. As a result of adding this extra layer, reflected ray 24, seen in FIGS. 1 and 2, is no longer present and microtip 19 is seen by an external viewer only in its true position, the ghost image that appeared to be coming from microtip 20 having been eliminated.

In order to manufacture the structure shown in FIG. 3 we begin with lower substrate 10 which is made of a dielectric material such as glass or silicon oxide. Layer 11, the cathode layer, composed of molybdenum, niobium, or similar material, is then deposited onto 10 and patterned and etched to form cathode columns. This is followed by the deposition of a dielectric material such as aluminum oxide or silicon oxide to a thickness between about 0.5 and 1 micron, to form layer 12 which fully covers layer 11. This is followed by the deposition of gate layer 13 (consisting of niobium, molybdenum, or similar material) which is patterned and etched to form rows that run at right angles to the aforementioned cathode columns.

Next, in a key step, anti-reflection coating 35 is deposited over the entire surface, thereby covering both the gate rows and the exposed dielectric surface. Details concerning the deposition of 35 will be given below. Then, at the intersections of the gate rows and cathode columns, openings are formed that extend through the anti-reflection layer, the gate layer, and the dielectric layer, down to the level of the cathode columns. This is followed by the formation of the cone shaped field emission microtips, which are individually located inside these openings. The base of each conical microtip is in contact with the cathode layer while its apex is in the same plane as the gate layer.

The structure is completed with the provision of dielectric upper substrate 16 on whose inward facing surface is transparent conducting layer 15 made of material such as ITO. A layer of a phosphor 14, comprising material such as ZnS or ZnO is laid down over 15 to a thickness of one or two layers.

Using suitable spacers (not shown) upper substrate 16 is permanently positioned between about 0.2 and 6 mm. above lower substrate 10. The entire structure is then enclosed with suitable side-walls (also not shown), evacuated, and permanently sealed together with assorted electrical leads (not shown) that allow connections to be made to the columns, rows, etc.

In an alternative embodiment of the method of the present invention, the formation of openings in the dielectric as well as the formation of the microtips is performed prior to the deposition of the anti-reflection coating. This version of the method means that no modification of the existing microtip formation process is needed. However, a selective etching step to remove anti-reflection material from inside the openings, particularly from the surfaces of the micro-tips, is then needed.

With regard to the anti-reflection coating itself, our preferred materials have been chromium oxide or carbon. The preferred deposition method for these has been sputtering but other methods such as vacuum evaporation or chemical vapor deposition could also be used. Preferred thickness for these anti-reflection coatings has been between about 1,000 and 5,000 Angstroms.

An even better anti-reflection coating can be formed by suspending carbon particles in a suitable binder. For example, a suspension of carbon black in a mixture of polyvinyl alcohol (PVA) and water was formed and then applied to the gate layer by spin coating. This was then heated to remove the water following which it was exposed to ultraviolet light . We have used a thickness range for the layer (after drying) between about 0.1 and 0.5 microns.

While the invention has been particularly shown and described with reference to the preferred embodiments thereof, it will be understood by those skilled in the art that various changes in form and details may be made without departing from the spirit and scope of the invention.

What is claimed is:

1. A field emission structure comprising:

a dielectric lower substrate;

a cathode conductor electrode on said lower substrate;

a dielectric layer, covering said cathode conductor electrode;

a gate electrode on said dielectric layer;

an anti-reflection layer on the gate electrode;

openings in said anti-reflection layer, extending through said gate electrode and said dielectric layer to the cathode conductor electrode;

cone shaped field emission microtips, individually located inside said openings, the base of each conical microtip being in contact with said cathode conductor electrode and the apex of each microtip being in the same plane as said gate electrode;

a dielectric upper substrate above the lower substrate, separated therefrom by a gap and having a lower surface;

a transparent conducting layer on said lower surface; and a layer of a phosphor on said transparent conducting layer.

2. The structure of claim 1 wherein said anti-reflection layer is taken from the group consisting of chromium oxide, pure carbon, and carbon particles in a binder.

3. The structure of claim 1 wherein the thickness of said anti-reflection layer is between about 1,000 and 5,000 Angstroms.

4. The structure of claim 1 wherein the phosphor is taken from the group consisting of zinc suphide and zinc oxide.

5. The structure of claim 1 wherein the gate electrode is niobium or molybdenum.

6. The structure of claim 1 wherein the transparent conducting layer is indium tin oxide.

7. The structure of claim 1 wherein said gap is between about 0.2 and 6 mm.

8. The structure of claim 1 wherein said dielectric layer is aluminum oxide or silicon oxide.

9. The structure of claim 1 wherein the thickness of said dielectric layer is between about 0.5 and 1 microns.

10. A method for manufacturing a field emission device comprising:

providing a dielectric lower substrate;

depositing a cathode layer on said lower substrate;

patterning and etching said cathode layer to form cathode columns;

depositing a dielectric layer to cover said cathode columns;

depositing a gate layer on said dielectric layer;

patterning and etching said gate layer to form gate rows that orthogonally intersect the cathode columns;

depositing an anti-reflection coating on the gate rows;

at said intersections between the gate rows and cathode columns, forming openings in said anti-reflection layer that extend through the gate rows and the dielectric layer down to the level of the cathode columns;

forming cone shaped field emission microtips, individually located inside said openings, the base of each conical microtip being in contact with said cathode layer and the apex of each microtip being in the same plane as said gate layer;

providing a dielectric upper substrate;

depositing a transparent conducting layer on said upper substrate;

depositing a layer of a phosphor on said transparent conducting layer; and permanently positioning said upper substrate above the lower substrate so that said phosphor layer faces the microtips.

11. The method of claim 10 wherein said anti-reflection layer is deposited by means of sputtering or vacuum evaporation or chemical vapor deposition.

12. The method of claim 10 wherein said anti-reflection layer is deposited to a thickness between about 1,000 and 5,000 Angstroms.

13. The method of claim 10 wherein depositing the anti-reflection layer further comprises:

forming a suspension of carbon particles in polyvinyl alcohol and water;

applying said suspension by spin coating;

heating the suspension to dry it; and exposing the dry suspension to ultraviolet light.

14. The method of claim 10 wherein the phosphor is deposited by spin coating.

15. The method of claim 10 wherein the phosphor is deposited to a thickness of 1 to 2 layers.

16. A method for manufacturing a field emission device comprising the sequential steps of:

providing a dielectric lower substrate;

depositing a cathode layer on said lower substrate;

patterning and etching said cathode layer to form cathode columns;

depositing a dielectric layer to cover said cathode columns;

depositing a gate layer on said dielectric layer;

patterning and etching said gate layer to form gate rows that orthogonally intersect the cathode columns;

at said intersections between the gate rows and cathode columns, forming openings in the gate layer that extend through the dielectric layer down to the level of the cathode columns;

forming cone shaped field emission microtips, individually located inside said openings, the base of each conical microtip being in contact with said cathode layer and the apex of each microtip being in the same plane as said gate layer;

depositing an anti-reflection coating on the lower substrate, including gate rows;

selectively removing said anti-reflection coating from said openings, including the microtips;

providing a dielectric upper substrate;

depositing a transparent conducting layer on said upper substrate;

depositing a layer of a phosphor on said transparent conducting layer; and permanently positioning said upper substrate above the lower substrate so that said phosphor layer faces the microtips.

17. The method of claim 16 wherein said anti-reflection layer is deposited by means of sputtering or vacuum evaporation or chemical vapor deposition.

18. The method of claim 16 wherein said anti-reflection layer is deposited to a thickness between about 1,000 and 5,000 Angstroms.

19. The method of claim 16 wherein depositing the anti-reflection layer further comprises:

forming a suspension of carbon particles in polyvinyl alcohol and water;

applying said suspension by spin coating;

heating the suspension to dry it; and exposing the dry suspension to ultraviolet light.

20. The method of claim 16 wherein the phosphor is deposited by spin coating to a thickness of 1 to 2 layers.

* * * * *